US007913776B2

(12) United States Patent
Nahmad

(10) Patent No.: US 7,913,776 B2
(45) Date of Patent: Mar. 29, 2011

(54) METHOD AND SYSTEM TO RECOVER USABLE OIL-BASED DRILLING MUDS FROM USED AND UNACCEPTABLE OIL-BASED DRILLING MUDS

(76) Inventor: David Gandhi Nahmad, Placentia, CA (US)

( * ) Notice: Subject to any disclaimer, the term of this patent is extended or adjusted under 35 U.S.C. 154(b) by 23 days.

(21) Appl. No.: 12/116,153

(22) Filed: May 6, 2008

(65) Prior Publication Data

US 2008/0277165 A1 Nov. 13, 2008

(51) Int. Cl.
*E21B 21/06* (2006.01)

(52) U.S. Cl. ..... 175/66; 175/206; 175/209

(58) Field of Classification Search ..... None
See application file for complete search history.

(56) References Cited

U.S. PATENT DOCUMENTS

| | | | | |
|---|---|---|---|---|
| 5,132,025 | A * | 7/1992 | Hays | 210/758 |
| 5,250,175 | A | 10/1993 | Des Ormeaux | |
| 6,214,236 | B1 | 4/2001 | Scalliet | |
| 6,294,093 | B1 | 9/2001 | Selvarajan et al. | |
| 6,658,757 | B2 | 12/2003 | Fout et al. | |
| 6,695,077 | B2 | 2/2004 | Szymocha et al. | |
| 6,886,273 | B2 | 5/2005 | Fout et al. | |
| 6,989,103 | B2 | 1/2006 | Mohsen et al. | |
| 2003/0100452 | A1 | 5/2003 | Mueller | |
| 2003/0136747 | A1 | 7/2003 | Wood et al. | |
| 2005/0145418 | A1 | 7/2005 | Cordova | |
| 2005/0279715 | A1 * | 12/2005 | Strong et al. | 210/774 |
| 2007/0021309 | A1 | 1/2007 | Bicerano | |
| 2007/0267325 | A1 | 11/2007 | Vu | |

FOREIGN PATENT DOCUMENTS

| | | |
|---|---|---|
| CA | 2436625 | 1/2002 |
| CA | 2436821 | 7/2002 |
| GB | 2347682 | 3/2000 |
| WO | WO8909091 | 3/1989 |
| WO | WO8902774 | 4/1989 |
| WO | WO9009507 | 2/1990 |
| WO | WO9222620 | 6/1992 |
| WO | WO9836154 | 2/1998 |
| WO | WO9905392 | 2/1999 |
| WO | WO9925497 | 5/1999 |
| WO | WO0075261 | 6/2000 |
| WO | WO0292187 | 5/2002 |
| WO | WO2004041400 | 9/2003 |
| WO | WO2006048618 | 5/2006 |

* cited by examiner

*Primary Examiner* — Zakiya W. Bates
(74) *Attorney, Agent, or Firm* — George S. Gray

(57) ABSTRACT

A system for treating spent/used Oil Based Drilling Muds (OBM's) to recover High Gravity Solids (HGS) for further reuse and to separate the invert emulsion from the Light Gravity Solids (LGS) with good characteristics also for further reuse. Separated LGS is processed to extract the remaining oil in order to render an environmentally safe solid fraction. The overflow of a screening or centrifugation of spent OBM enters a reactor where reagents are added and mixed to control the oil/water ratio of the recovered emulsion and to reduce the LGS concentration. A catalyst is added before adding a final reagent that initiates the reaction. Upon centrifuging the reacted mix, the recovered emulsion is the overflow and a thin layer of LGS forms slightly below the emulsion. The underflow of this separation is further sedimented by gravity and the phase dispersant layer is decanted and sent for reuse.

44 Claims, 3 Drawing Sheets

METHOD AND SYSTEM TO RECOVER USABLE OIL-BASED DRILLING MUDS FROM USED AND UNACCEPTABLE OIL-BASED DRILLING MUDS

FIELD OF THE INVENTION

This invention relates to drilling procedures on oil based muds for lubrication and hole coating in a cyclic basis and that require specific quality parameters for their use. The invention describes a process involving physical and chemical treatments to recover the inverted emulsion.

BACKGROUND OF THE INVENTION

During the operation of rotary drilling wells for the extraction of gas and/or oil, a drilling fluid or mud is used to provide lubrication and cooling to the drill bit and to remove cuttings from the bottom of the hole to the surface. This drilling fluid will also control subsurface pressures and isolate migrating fluids from the formation by providing enough hydrostatic pressure, etc. The drilling fluid or mud is pumped down the rotating drill pipe, through the bit and up the annular space between the formation or steel casing and the rotating pipe to the surface.

The drilling fluids can be of any oil based, water based or a combination of oil and water. The non-aqueous fluids include but are not limited to diesel, mineral oils, synthetic oils, unsaturated olefins, organic esters or a combination thereof. Other components such as calcium chloride brine, emulsifying surfactants, rheology modifiers and wetting agents, are also added to the base fluid resulting in a water in oil emulsion, also referred as an invert emulsion. The density of the drilling mud is adjusted with weighing agents such as barite and hematite.

During drilling, the drill bit generates cuttings as it moves forward; these cuttings are small pieces of shale and rock and are transported upwards to the surface in the return flow of the drilling muds to the drilling platform. Other liquid contaminants such as water, brines and crude oil from the formation can get entrained in the drilling muds. Solid and liquid contamination alters the original mud properties causing problems during the operation. In situ equipment such as shale shaker screens and centrifuges remove most of the large particles above 7 microns. However, formation particles that are less than about 5 to 7 microns are more difficult to remove; these are considered the Low Gravity Solids. These LGS can build up in the mud system and cause drilling problems like drill pipe sticking, increased pipe torque, and other high viscosity problems.

Mechanical methods for removing the LGS have been tried like centrifuges; it has been found that long retention times are needed to remove the colloidal particles if they can be removed at all. Thus there is a need for a system that can remove or reduce the LGS while maintaining or improving the mud or emulsion properties for further use. This system could be implemented in situ at the drilling platform or at the mud plants for processing the muds returning from the drilling operations. The need for a comprehensive system where there are no environmental hazards in all the by-products and recycling or disposing does not constitute a threat for the surrounding environment.

SUMMARY OF THE INVENTION

Spent or used Oil-Based Drilling Muds (OBM) with unacceptable quality for further drilling is processed through a series of physical-chemical processes that allow the recovery of a good quality emulsion ready to be mixed back into a usable drilling mud. The method encompasses processes that render inert and environmentally sound by-products that do not represent a potential hazard for the environment and can be disposed or reused safely.

The used OBM is subjected to an initial screening to remove large particles and rock. A further centrifugation can be used to recover, as the underflow, valuable emulsion wet with High Gravity Solids (HGS), mainly Barite, to be added to the final emulsion. The overflow of the centrifuge consists of an inverted emulsion carrying contaminants such as fine solids, known as Light Gravity Solids (LGS), water, crude oil and brines. The emulsions change in composition and properties that make it difficult to continue using them. Usually an emulsion with a concentration higher than 4% in LGS is no longer good to continue drilling and has to be discarded. As the contaminants contents increase in the emulsion, the electrical Stability Voltage (ESV) also starts to drop and can reach levels of unacceptability. Many of the original parameters of the emulsion have to be conserved or improved in the recycling process; these parameters include:

Oil/Water Ratio (OWR).
Electrical Stability Voltage (ESV).
Light Gravity Solids concentration (LGS).
Rheology.
Weight (in lbs/gal).
API High Pressure—High Temperature Filtrate.

Either the spent OBM after screening or the overflow of the first centrifugation enters a reactor where an inorganic salt is added and mixed to control the OWR of the recovered emulsion and to reduce the LGS concentration. A light concentration electrolyte can be added to promote an extra layer for separation between the HGS and the emulsion. A perchlorate or permanganate salt is added to the mix as a catalyst in small quantities before adding an organic or metallic peroxide. An exothermic reaction evolves that allows for the separation of the contaminants of the emulsion; the reaction has to be controlled in order to avoid the emulsion to dissociate in its phases. The reacted mix is then centrifuged where the recovered emulsion is the overflow, a thin layer of LGS will form slightly below the emulsion so separation has to be accurate. The underflow of this separation is further sedimented by gravity and the electrolyte layer is sent for reuse. At this point the recovered emulsion will probably meet specs for reuse, if not a secondary process of emulsion "washing" is implemented in a second reactor where a mixture of one or several compound of the form R—X, where R is an alkyl radical with 1 to 8 carbons and X is a hydroxyl radical this is a diluted water mixture that is thoroughly agitated and centrifuged allowing the emulsion to lose more of the LGS and increase its ESV. This overflow is the polished recovered emulsion and after QA/QC can be remixed to form a recycled usable OBM. The solids separated from the underflow of the centrifugation steps can be further cleaned and disposed by means of using a non-water miscible mixture of organic solvents including esters, alcohols and ketones to remove the oil fraction for the solids below 3% concentration by mass. The solids are immersed in a bath of solvent at atmospheric temperature and pressure but in a closed reactor to form slurry; a light electrolyte is added to make a separation phase. The agitated mix is fed to a decanter centrifuge and separated the upper liquid phases go to a gravity separator and the mix oil/solvent is decanted for further processing. The underflow is the solids wet now with solvent and electrolyte this is sent to a heated auger to evaporate the solvent, which is vacuumed through a condenser for its recovery. The mixture oil solvent is also heated inside a thin layer evaporator where the solvent is volatized and vacuumed through a condenser for its recovery and reuse. The dry solids should contain no more than 3% oil by weight and should be acceptable for a non-hazardous disposal. The recovered oil can be used to prepare new emulsion.

In some exemplary embodiments of my invention, I have provided a process for recovering an oil-based drilling fluid from used oil-based drilling mud, the used oil-based drilling mud having drilling cuttings material and a fluid phase, the fluid phase having high gravity solid material and low gravity solid material, the process comprising: separating the drilling cuttings material from the fluid phase of the used oil-based drilling mud, the step of separating the drilling cuttings material from the fluid phase of the used oil-based drilling mud further comprising screening the used oil-based drilling mud; separating the high gravity solid material from the fluid phase of the used oil-based drilling mud the step of separating the high gravity solid material from the fluid phase of the used oil-based drilling mud at least one, further comprising centrifuging the used oil-based drilling mud, such centrifugation discharging a first overflow fraction and a first underflow fraction, the first overflow fraction comprising an emulsion and low gravity solid material and the first underflow fraction comprising high gravity solid material; and separating the low gravity solid material from the fluid phase of the used oil-based drilling mud, the step of separating the low gravity solid material from the fluid phase of the used oil-based drilling mud further comprising: exothermically reacting the first overflow fraction such that the emulsion and at least some of the low gravity solid material is separated; and centrifuging the reacted first overflow fraction such that a second overflow fraction is discharged, the second overflow fraction substantially comprising the emulsion and a reduced amount of low gravity solid material, and further such that a second underflow fraction is discharged, the second underflow fraction comprising the separated low gravity solid material.

In some exemplary embodiments, the used oil-based mud fluid phase further comprises contaminants in addition to the low gravity solid material, and further wherein the exothermic reacting of the first overflow fraction separates at least some of the additional contaminants.

In some exemplary embodiments, the high gravity solid material comprises at least a weighing material.

In some exemplary embodiments, the weighing material is barite.

In some exemplary embodiments, high gravity solid material above 10 microns is separated from the fluid phase.

In some exemplary embodiments, the process further comprises chemically washing the second overflow fraction, then centrifuging the washed second overflow fraction such that a third overflow fraction is discharged, the third overflow fraction substantially comprising the emulsion and a further reduced amount of low gravity solid material, and further such that a third underflow fraction is discharged, the third underflow fraction comprising at least some of the second overflow fraction separated low gravity solid material.

In some exemplary embodiments, exothermically reacting the first overflow fraction further comprises: adding the first overflow fraction to an inorganic salt, the inorganic salt concentration being between 0.5 gr/lt of the first overflow fraction to 5.0 gr/lt of the first overflow fraction, for at least 2 minutes agitation time; adding a carbon in the range of 0.5 gr/lt of the first overflow fraction to 3.5 gr/lt of the first overflow fraction and agitating for at least 1 minute, the carbon being selected from the group consisting of carbon powder and carbon black; starting the exothermic reaction by adding a peroxide in the range of 15 ml/lt of the first overflow fraction to 35 ml/lt of the first overflow fraction, the concentration of the peroxide ranging from 35% to 50% prior to adding, the first overflow fraction with the added peroxide being continuously agitated, the agitation accelerating the exothermic reaction; adding a catalyst in the range of 0.1 gr/lt of the first overflow fraction to 1.0 gr/lt of the first overflow fraction, the catalyst being selected from the group consisting of perchlorate salt, permanganate salt, and potassium permanganate; and adding an electrolyte, the electrolyte being selected from the group consisting of ammonia and sodium hypochlorite, the electrolyte concentration being in the range of 1.0% minimum v/v and 12% maximum v/v in an amount of 100 ml/lt of the first overflow fraction to 600 ml/lt of the first overflow fraction.

In some exemplary embodiments, the inorganic salt is selected from the group consisting of sodium phosphates, potassium phosphates, and chlorides. In some exemplary embodiments, the peroxide is selected from the group consisting of hydrogen peroxide, sodium peroxide, and zinc peroxide. In some exemplary embodiments, at least some of the peroxide is added before the catalyst is added, and at least some of the peroxide is added after the catalyst is added. In some exemplary embodiments, the peroxide is selected from the group consisting of organic peroxides and metallic peroxides.

In some exemplary embodiments, exothermically reacting the first overflow fraction further comprises: adding the first overflow fraction (lighter fraction) to an inorganic salt preferably in the range 0.5 gr/lt of fluid to 5.0 gr/lt of the first overflow fraction for at least 2 minutes agitation time; adding a carbon in the range of 0.5 gr/lt to 3.5 gr/lt and agitating for at least 1 minute, the carbon being selected from the group consisting of carbon powder and carbon black; adding a peroxide in the range of 15 ml/lt to 35 ml/lt, on a 35% to 50% concentration basis, the peroxide being selected from the group consisting of organic peroxide, metallic peroxide, hydrogen peroxide, sodium peroxide and zinc peroxide; adding a catalyst in the range of 0.1 gr/lt to 1.0 gr/lt, the catalyst being selected from the group consisting of perchlorate salt, permanganate salt and potassium permanganate; adding a peroxide in the range of 15 ml/lt to 35 ml/lt, on a 35% to 50% concentration basis, the peroxide being selected from the group consisting of organic peroxide, metallic peroxide, hydrogen peroxide, sodium peroxide and zinc peroxide, with agitation such that the exothermic reaction continues to evolve; and adding an electrolyte, the electrolyte being selected from the group consisting of ammonia and sodium hypochlorite, the electrolyte concentration being in the range of 1.0% minimum v/v and 12% maximum v/v, in an amount of 100 ml/lt to 600 ml/lt.

In some exemplary embodiments, the second overflow fraction emulsion is from a supernatant obtained during the centrifugation of the exothermically reacted first overflow fraction.

In some exemplary embodiments, separating the low gravity solid material from the fluid phase of the used oil-based drilling mud, further comprises: washing the second overflow fraction emulsion by reacting and agitating the second overflow fraction emulsion in a mixture, the mixture comprising at least one reagent compound of the form X—R—X, at least one reagent compound of the form R—X where R is an alkyl radical with 1 to 8 carbons, and X is a hydroxyl radical, and an electrolyte in an amount up to and including 300 ml/lt of emulsion; and centrifuging the washed second overflow fraction emulsion, the centrifugation separating the second overflow fraction emulsion into a third overflow fraction, comprising a second emulsion, and a third underflow fraction, comprising at least one of the reagents and low gravity solid material.

In some exemplary embodiments, the at least one reagent of the form X—R—X comprises ethylene glycol at 150-300 ml/l. In some exemplary embodiments, the at least one reagent of the form R—X comprises methanol at 300 ml/l. In some exemplary embodiments, up to and including 300 ml/lt of the electrolyte is added and the electrolyte is selected from the group consisting of ammonia and sodium hypochlorite up to and including 300 ml/l.

In some exemplary embodiments, the step of separating the low gravity solid material from the fluid phase of the used oil-based drilling mud, further comprises: filtering, using a filter press, the third underflow portion such that the at least one reagent and the low gravity solid material are separated; and routing the separated at least one reagent for reuse.

In some exemplary embodiments, the process further comprises secondarily treating at least some of the low gravity solid material separated from the at least one reagent, the secondarily treated portion of the separated low gravity solid material being oil-wet, the secondary treatment comprising: adding a compound organic solvent that is non-miscible in water to the separated low gravity solid material; mixing thoroughly; centrifuging the mixture thereby separating the low gravity solid material from the solvent and the oil; disposing of such low gravity solid material; and retaining the mixture of separated oil and solvent.

In some exemplary embodiments, the secondary treatment is optional in accordance with the results of at least one test, the test being selected from the group consisting of a total petroleum hydrocarbons concentration (mg/kg) and a toxicity characteristics leaching procedure.

In some exemplary embodiments, the process further comprises secondarily treating at least some of the low gravity solid material separated from the at least one reagent, the secondarily treated portion of the separated low gravity solid material being oil-wet, the secondary treatment comprising: combining the separated low gravity solid material with a non-water miscible mixture of organic solvents, the solvents comprising at least one ester, at least one alcohol, at least one acetate, and at least one ketone in a reactor to form a slurry, the slurry having a liquid phase and a solid phase; adding a light electrolyte to the combination; separating the slurry liquid phase from the solid phase, the liquid phase including the solvent and oil, the solid phase having low gravity solid material and residual solvent; separating the low gravity solid material from the residual solvent by evaporation; disposing of the low gravity solid material; and separating the oil from the solvent in the liquid phase by evaporation; routing the separated oil for reuse; and condensing the evaporated solvent and routing the liquid solvent for reuse.

In some exemplary embodiments, the inorganic salt and carbon are present in amounts necessary to maintain an oil to water ratio in the range of 60/40 to 90/10.

In some exemplary embodiments, the second underflow fraction further comprises at least the electrolyte and low gravity solid material, and the step of separating low gravity solid material from the fluid phase of the used oil-based drilling mud, further comprises: filtering, using a filter press, the second underflow portion such that the electrolyte and the low gravity solid material are separated; and routing the separated electrolyte for reuse.

In some exemplary embodiments, the process further comprises secondarily treating at least some of the low gravity solid material separated from the electrolyte, the secondarily treated portion of the separated low gravity solid material being oil-wet, the secondary treatment comprising: adding a compound organic solvent that is non-miscible in water to the separated low gravity solid material; mixing thoroughly; centrifuging the mixture thereby separating the low gravity solid material from the solvent and the oil; disposing of such low gravity solid material; and retaining the separated oil and solvent.

In some exemplary embodiments, the secondary treatment is optional in accordance with the results of at least one test, the test being selected from the group consisting of a total petroleum hydrocarbons concentration (mg/kg) and a toxicity characteristics leaching procedure.

In some exemplary embodiments the process further comprises, secondarily treating at least some of the low gravity solid material separated from the electrolyte, the secondarily treated portion of the separated low gravity solid material being oil-wet, the secondary treatment comprising: combining the separated low gravity solid material with a non-water miscible mixture of solvents, the solvents comprising an azeotropic mixture of at least one alcohol, at least one ketone, and at least one hydrocarbon, the hydrocarbon being selected from the group consisting of aliphatic hydrocarbons and aromatic hydrocarbons, in a reactor to form a slurry, the slurry having a liquid phase and a solid phase; adding a light electrolyte to the combination; separating the slurry liquid phase from the solid phase, the liquid phase including the solvent and oil, the solid phase having low gravity solid material and residual solvent; separating the low gravity solid material from the residual solvent by evaporation; disposing of the low gravity solid material; and separating the oil from the solvent in the liquid phase by evaporation; routing the separated oil for reuse; and condensing the evaporated solvent and routing the liquid solvent for reuse.

In some exemplary embodiments, the solvent further comprises at least one acetate. In some exemplary embodiments, solvent further comprises at least one ester. In some exemplary embodiments, the electrolyte is added at a concentration of up to and including 2.0% v/v In an amount of 400 ml/lt to 750 ml/lt of the slurry volume. In some exemplary embodiments, separating the liquid phase from the solid phase comprises centrifugation. In some exemplary embodiments, the solvent is volatized and vacuumed through a condenser. In some exemplary embodiments, the disposed low gravity solid material contains up to and including 3% oil by weight after solvent evaporation.

In some exemplary embodiments of my invention, I have provided a process for recovering an oil-based drilling fluid from used oil-based drilling mud, the used oil-based drilling mud having drilling cuttings material and a fluid phase, the fluid phase having high gravity solid material and low gravity solid material, the process comprising: separating the drilling cuttings material from the fluid phase, leaving a first modified fluid phase; separating at least some of the high gravity solid material from the first modified fluid phase, leaving a second modified fluid phase; separating at least some of the low gravity solid material from the second modified fluid phase to form a third modified fluid phase by: exothermically reacting the second modified fluid phase in a reactor using a plurality of reagents and agitation; and centrifuging the reacted second modified fluid phase, such that low gravity solid material is removed from the second modified fluid phase leaving the third modified fluid phase.

In some exemplary embodiments, the plurality of reagents comprises: an inorganic salt, a carbon, a peroxide, an electrolyte, and an oxidizing reagent selected from the group consisting of perchlorate salt, and permanganate salt.

In some exemplary embodiments, the inorganic salt is selected from the group consisting of sodium phosphates, potassium phosphates, and chlorides. In some exemplary embodiments, the carbon is selected from the group consisting of carbon black, and carbon powder. In some exemplary embodiments, the peroxide is selected from the group consisting of organic peroxides and metallic peroxides. In some exemplary embodiments, the peroxide is selected from the group consisting of hydrogen peroxide, sodium peroxide and zinc peroxide. In some exemplary embodiments, the electrolyte is selected from the group consisting of ammonia and sodium hypochlorite.

In some exemplary embodiments, the process further comprises: separating additional low gravity solid material from the third modified fluid phase to form a fourth modified fluid phase by: reacting the third modified fluid phase in a second reactor using water, a plurality of reagents and agitation; and centrifuging the reacted third modified fluid phase, such that the low gravity solid material is removed from the third modified fluid phase leaving the fourth modified fluid phase.

In some exemplary embodiments, the plurality of reagents comprises: a glycol, an alcohol, and an electrolyte. In some exemplary embodiments, the glycol is selected from the group consisting of ethylene glycol, and propylene glycol. In some exemplary embodiments, the alcohol is methanol. In some exemplary embodiments, the electrolyte is selected from the group consisting of ammonia and sodium hypochlorite.

In some exemplary embodiments, the plurality of reagents comprises a glycol, an alcohol, and an electrolyte. In some exemplary embodiments, the glycol is selected from the group consisting of ethylene glycol, and propylene glycol. In some exemplary embodiments, the alcohol is methanol. In some exemplary embodiments, the electrolyte is selected from the group consisting of ammonia and sodium hypochlorite.

In some exemplary embodiments, the process further comprises: bathing and agitating the removed low gravity solid material in a solvent in a third reactor, the bathing and agitating forming a slurry; centrifuging the slurry such that the bathed low gravity solid material and at least some of the solvent are separated; and drying the bathed low gravity solid material for additional separation of the low gravity solid material from the solvent.

In some exemplary embodiments, the solvent comprises at least one alcohol, at least one ketone, and an azeotropic mixture having a hydrocarbon, wherein the hydrocarbon is selected from group consisting of an aliphatic hydrocarbon, and an aromatic hydrocarbon.

In some exemplary embodiments, an electrolyte is added to the third reactor during the bathing and agitating.

In some exemplary embodiments, the centrifugation of the used oil-based drilling mud is continuous until high gravity solid material above 10 microns is separated from the fluid phase. In some exemplary embodiments, the centrifugation of the used oil-based drilling mud is continuous until barite above 5-7 microns is separated from the fluid phase.

In some exemplary embodiments of my invention, I have provided, a system for recovering an oil-based drilling fluid from used oil-based drilling mud, the used oil-based drilling mud having drilling cuttings material and a fluid phase, the fluid phase having high gravity solid material and low gravity solid material, the process comprising: means for separating the drilling cuttings material from the fluid phase, leaving a first modified fluid phase; means for separating at least some of the high gravity solid material from the first modified fluid phase, leaving a second modified fluid phase; means for separating at least some of the low gravity solid material from the second modified fluid phase to form a third modified fluid phase, such means further comprising: means for exothermically reacting the second modified fluid phase in a reactor using a plurality of reagents and agitation; and means for centrifuging the reacted second modified fluid phase, such that low gravity solid material is removed from the second modified fluid phase leaving the third modified fluid phase.

In some exemplary embodiments of my invention I have provided a process for recovering an oil-based drilling fluid from spent oil-based drilling mud, which process includes: separating unwanted drilling cuttings material from the fluid phase of the used drilling mud; separating High Gravity Solid (HGS) material from the fluid phase of the used drilling mud for further reuse or reprocessing and separating the unwanted Low-Gravity Solid (LGS) material from the fluid phase of the used drilling mud.

In some exemplary embodiments, the separation first two steps include screening and or centrifugation.

In some exemplary embodiments, the third separation comprises an exothermic reaction followed by centrifugation and a chemical wash.

In some exemplary embodiments, the wet high gravity solid material is subjected to a centrifuging process wherein: anted high-gravity solid material is retained; and unwanted high-gravity solid material is subject to a secondary treatment wherein the secondary treatment includes: adding a compound organic solvent that is non-miscible in water to the HGS; mixing thoroughly; separating the solid material from solvent and oil using a centrifuge; disposing of the environmentally safe solid material; retaining the oil fraction; and retaining the solvent fraction.

In some exemplary embodiments, the separation includes: combining the solid material with a non-water miscible mixture of organic solvents including esters, and/or alcohols, acetates, and/or, and/or ketones in a reactor to form a slurry; adding a light electrolyte; separating the liquid phase from the solid phase; separating the solid fraction from residual solvent by evaporation; separating the oil from the solvent in the liquid fraction by evaporation; disposing of the dry solids.

In some exemplary embodiments, the electrolyte is added at a concentration of equal to or less than 2.0% v/v In an amount of 400 ml/lt to 750 ml/lt.

In some exemplary embodiments, the separation includes centrifugation

In some exemplary embodiments, the solvent is volatized and vacuumed through a condensing means for its recovery.

In some exemplary embodiments, the dry solids contain no more than 3% oil by weight.

In some exemplary embodiments, the further treatment includes: separating the solid material from solvent and oil; disposing of the environmentally safe solid material; retaining the oil fraction; and retaining the solvent fraction.

In some exemplary embodiments, the secondary treatment includes: adding a compound organic solvent that is non-miscible in water to the HGS; mixing thoroughly, separating the solid material from solvent and oil; disposing of the environmentally safe solid material; retaining the oil fraction; and retaining the solvent fraction.

In some exemplary embodiments, the separation includes: combining the solid material with a non-water miscible mixture of organic solvents including esters, and/or alcohols, acetates, and/or, and/or ketones in a reactor to form a slurry; adding a light electrolyte; separating the liquid phase from the solid phase; separating the solid fraction from residual solvent by evaporation; separating the oil from the solvent in the liquid fraction by evaporation; and disposing of the dry solids.

In some exemplary embodiments, the drilling cuttings are separated from the drilling mud by a process, which includes screening the drilling mud.

In some exemplary embodiments, the high gravity solids (solid particles larger than 10 micron, mainly barite) are separated from the drilling fluid by a process which includes: centrifuging the drilling mud; and retaining the overflow fraction (lighter fraction).

In some exemplary embodiments, the process includes (i) adding the overflow fraction (lighter fraction) to an inorganic salt preferably in the range 0.5 gr/lt of fluid to 5.0 gr/lt of fluid for at least 2 minutes reaction time; (ii) adding of fine carbon powder or Carbon black in the range of 0.5 gr/lt of fluid to 3.5 gr/lt of fluid and agitated for at least 1 min; (iii) adding an organic or metallic peroxide like hydrogen peroxide, sodium peroxide or zinc peroxide in amounts of 15 ml/lt to 35 ml/lt on a 35% to 50% concentration basis; and (iv) adding a perchlorate or permanganate salt in the range of 0.1 gr/lt to 1.0 gr/lt preferably potassium permanganate; (v) adding of an organic or metallic peroxide like hydrogen peroxide, sodium peroxide or zinc peroxide in the range of 15 ml/lt to 35 ml/lt on a 35% to 50% concentration basis for continuously agitated and the exothermic reaction continues to evolve; (vi) adding of an electrolyte, selected from the group including ammonia and sodium hypochlorite at preferably a light (1.0% minimum v/v) concentration, most preferably a light (12% maximum v/v) concentration in an amount of 100 ml/lt to 600 ml/lt.

In some exemplary embodiments, the desired emulsion is separated from the contaminants following or during the ensuing exothermic reaction by way of a means of centrifugation.

In some exemplary embodiments, the ensuing underflow that contains the electrolyte and the LGS is separated by way of filtration (using a filter press) and the electrolyte layer is collected thereby from the underflow.

In some exemplary embodiments, the underflow is concentrated and the solid material obtained from the filter press is tested; environmentally safe material is discarded; and contaminated material is exposed to a secondary treatment to be rendered environmentally safe for disposal, wherein secondary treatment includes: adding a compound organic solvent that is non-miscible in water to the high gravity solids; mixing thoroughly; separating the solid material from solvent and oil using a centrifuge; disposing of the environmentally safe solid material; retaining the oil fraction; and retaining the solvent fraction.

In some exemplary embodiments, testing includes: Total Petroleum Hydrocarbons concentration (mg/kg) and Toxicity Characteristics Leaching Procedure (TCLP) test.

In some exemplary embodiments, the secondary treatment includes: adding a compound organic solvent that is non-miscible in water to the high gravity solids; mixing thoroughly; separating the solid material from solvent and oil; disposing of the environmentally safe solid material; retaining the oil fraction; and retaining the solvent fraction.

In some exemplary embodiments, the desired emulsion is the overflow fraction (light fraction) of the supernatant obtained following centrifugation.

In some exemplary embodiments, the recovered emulsion is further treated (if necessary) in a mixture with one or more compounds: where the compounds are of the form X—R—X, like ethylene glycol at 150-300 ml/l and R—X like methanol at 300 ml/l where R is an alkyl radical with 1 to 8 carbons and X is a hydroxyl radical; and an electrolyte like sodium hypochlorite up to 300 ml/l; wherein the washing includes agitation and/or centrifugation.

In some exemplary embodiments, the inorganic salt and carbon are added in amounts necessary to maintain an Oil to Water Ratio of 60/40 to 90/10 or as desired as a good output.

In some exemplary embodiments, an oil-based drilling fluid emulsion is recovered from used oil-based drilling mud for use in drilling operations.

In some exemplary embodiments, I have provided a process for rendering waste matter environmentally sound and for recovering oil from the same, which includes: separating the solid material from the solvent and oil components; and separating the oil from the solvent.

In some exemplary embodiments, the process includes: separating the solid material from solvent and oil; disposing of the dry solid material; retaining the oil fraction; and retaining the solvent fraction.

In some exemplary embodiments, the process includes: combining the solid material with a non-water miscible mixture of organic solvents including esters, and/or acetates, and/or alcohols and/or ketones in a reactor to form a slurry; adding a light electrolyte; separating the liquid phase from the solid phase using a centrifuge; separating the solid fraction from residual solvent by evaporation; separating the oil from the solvent in the liquid fraction by evaporation; and disposing of the dry solids.

In some exemplary embodiments, wherein the electrolyte is added at a concentration of equal to or less than 2% v/v In an amount of 400 ml/lt to 750 ml/lt.

In some exemplary embodiments, the separation includes centrifugation, evaporation and condensation.

In some exemplary embodiments, the solvent is volatized and vacuumed through a condensing means for its recovery.

In some exemplary embodiments, the dry solids contain no more than 3% oil by weight.

In some exemplary embodiments, the first two separation steps include centrifugation, evaporation and condensation.

In some exemplary embodiments, the process includes: separating the solid material from solvent and oil; disposing of the dry solid material; retaining the oil fraction; and retaining the solvent fraction.

In some exemplary embodiments, I have provided a system for recovering a high-quality oil-based drilling fluid emulsion from used oil-based drilling mud for use in drilling operations and rendering waste matter which is not suitable for reuse in drilling fluids inert and environmentally sound and for recovering oil from the same, which includes: removing unwanted drilling cuttings from the liquid or colloid phase of the used drilling mud; and separating unwanted high gravity solid particles from the liquid or colloid phase of the used drilling mud; separating the unwanted low-gravity solid material from the liquid or colloid phase of the used drilling mud; separating the waste solid material from the waste solvent and oil components; and separating residual oil from the solvent.

DETAILED DESCRIPTION OF THE INVENTION

Figure 1:
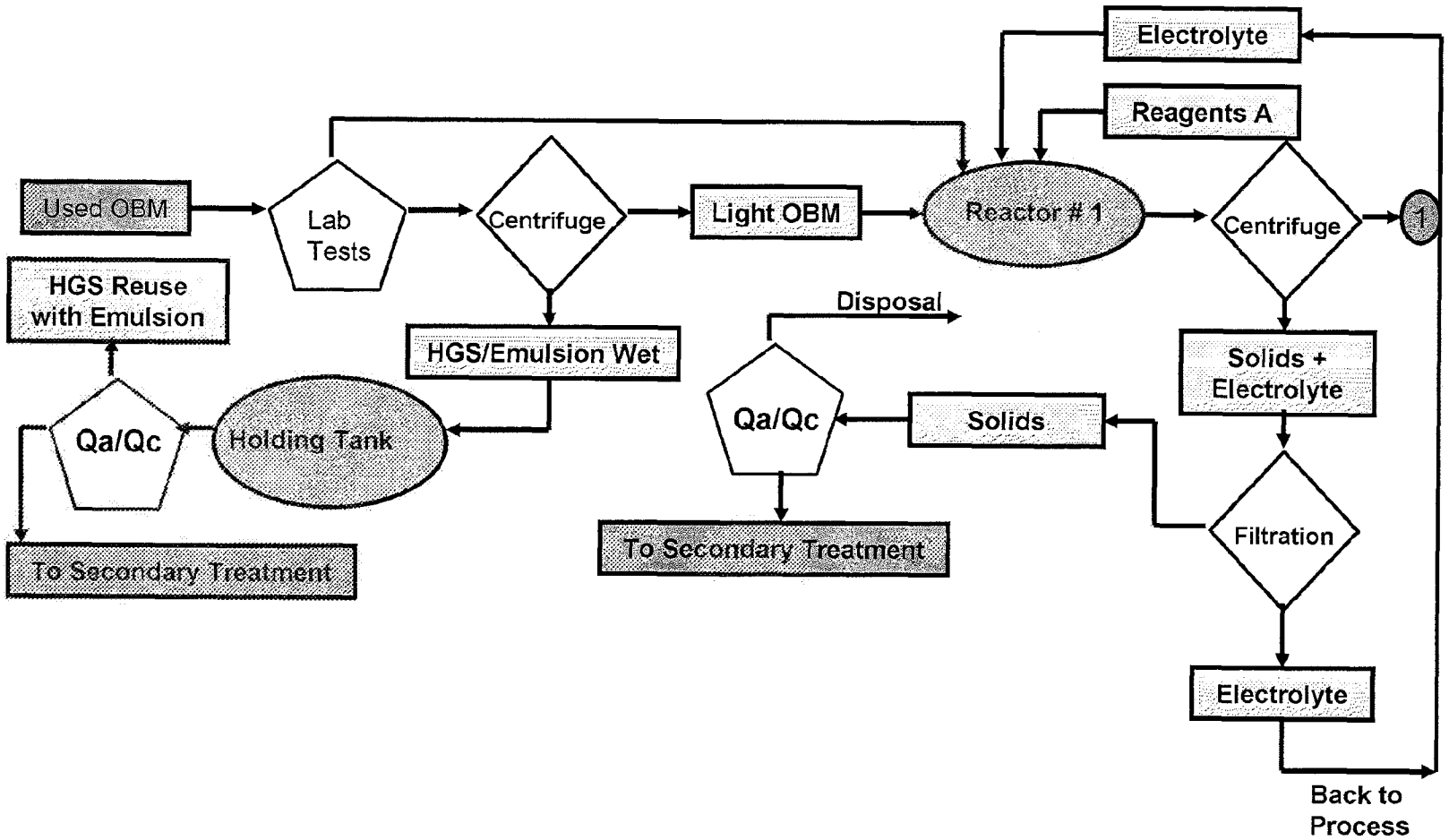
FIG. 1 illustrates part 1 of the emulsion recovery process of present invention.

The present invention relates to methods and apparatus for treatment of used Oil Based drilling Muds (OBM's) for barite and emulsion recovery for reuse and for a safe disposal of the Light Gravity Solids (LGS). The system recovers a fraction of the oil used for the emulsion as illustrated in FIG. 1.

Cuttings (particles larger than 1 mm) carried by the OBM's are pumped to and separated through a shale shaker or centrifuge (using conventional techniques) the recovered OBM is tested for quality for further drilling, the parameters tested are:

Oil/Water Ratio (OWR).

Electrical Stability Voltage (ESV).

Light Gravity Solids concentration (LGS).

Rheology.

Weight (in lbs/gal).

API High Pressure—High Temperature Filtrate.

The above parameters will be determined the condition for drilling or if the emulsion has to be processed or discarded. If further processing is needed, dilution with new emulsion and barite can be employed but it increments considerably the volume of muds creating storage problems. Centrifugation can also be employed but its ability to remove LGS is limited and waste streams are created that can pose a threat to the environment.

The system described here deals with a novel approach to recover valuable emulsion and barite (HGS) and to treat the separated LGS to produce by-products that can be recycled (clean oil/clean solids).

Under this scope, used OBM that does not meet quality requirements for drilling is pumped continuously into a decanter centrifuge that allows the HGS to be separated from the LGS/Emulsion/Water. The underflow of this centrifuge is the HGS and they are stored for future OBM preparation or sent to a secondary process for treatment and disposal. The overflow of the centrifuge is the light OBM (LGS/Emulsion/Water) which is sent to a reactor tank fitted with a variable speed agitator and a temperature measuring device that can be coupled to a Programmable Logic Controller (PLC) to automate the system.

The reactor tank is fitted with a chemical feeding system consisting of 4-day tanks fitted with agitators and metering pumps for liquid reagent dispensing. The chemicals can also be added in powder using three powder feeding whoppers and one-day tank with a metering pump.

Using the chemical feeding system tied to the reactor, an inorganic salt from the group including sodium and potassium phosphates, and chlorides is added first while agitation takes place for at least 2 minutes. Carbon powder or carbon black is now added through the chemical feeding system and agitated for at least 1 minute as shown in Table 1 below.

TABLE 1

CHEMICAL USAGE RANGE OBM EMULSION RECOVERY

| PROCESS | REAGENT | CONC. | MIN | UNIT | MAX | UNIT | REUSE |
|---|---|---|---|---|---|---|---|
| Promary Process | Inorganic Salt | 100% | 0.50 | gr/lt (OBM) | 5.00 | gr/lt (OBM) | NO |
| | Carbon | 100% | 0.50 | gr/lt (OBM) | 3.50 | gr/lt (OBM) | NO |
| | Peroxide (organic/metallic) | 35% | 35.00 | ml/lt (OBM) | 70.00 | ml/lt (OBM) | NO |
| | Perchlorate or Permanganate Salt | 100% | 0.10 | gr/lt (OBM) | 1.00 | gr/lt (OBM) | NO |
| | Electrolyte | 2% | 200.00 | ml/lt (OBM) | 700.00 | ml/lt (OBM) | YES |
| Wash | Propylene Glycol | 10% | 100.00 | ml/lt (RE) | 300.00 | ml/lt (RE) | YES |
| | Methanol | 90% | 200.00 | ml/lt (RE) | 400.00 | ml/lt (RE) | YES |
| | $H_2O$ (water) | 100% | 300.00 | ml/lt (RE) | 600.00 | ml/lt (RE) | YES |
| Secondary Treatment | Aliphatic, Aromatic Hydrocarcons | 100% | 600.00 | ml/lt (TS) | 1200.00 | ml/lt (TS) | YES |
| | Alcohols | 100% | 110.00 | ml/lt (TS) | 220.00 | ml/lt (TS) | YES |
| | Ketones | 100% | 110.00 | ml/lt (TS) | 220.00 | ml/lt (TS) | YES |
| | Electrolyte | 2% | 300.00 | ml/lt (TS) | 750.00 | ml/lt (TS) | YES |

OBM Oil Eased Mud
RE Recovered Emulsion
TS Treated Solids

Organic or metallic peroxide follows, this starts the reaction on a slow pace, a catalyst like a perchlorate or permanganate salt is followed using also the chemical feeding system. The reaction accelerates liberating more energy in the form of heat; gases are also released at this point. The chemical feeding system adds more of the organic or metallic peroxide to enhance the reaction while agitation helps in controlling the release of minute gas bubbles. Agitation continues in the reactor for the rest of the reaction 15 to 30 minutes.

An light electrolyte of the group of ammonia or sodium hypochlorite can be added here and flash mix is used to disperse it. This mix is now gravity fed into a buffer tank.

Depending on the chemical feeding system, all these reagents can be added via powder feeding machines (weigh dosing) or diluted in transport liquids like oils or water using the chemical feeding pumps (volume dosing).

Figure 2:
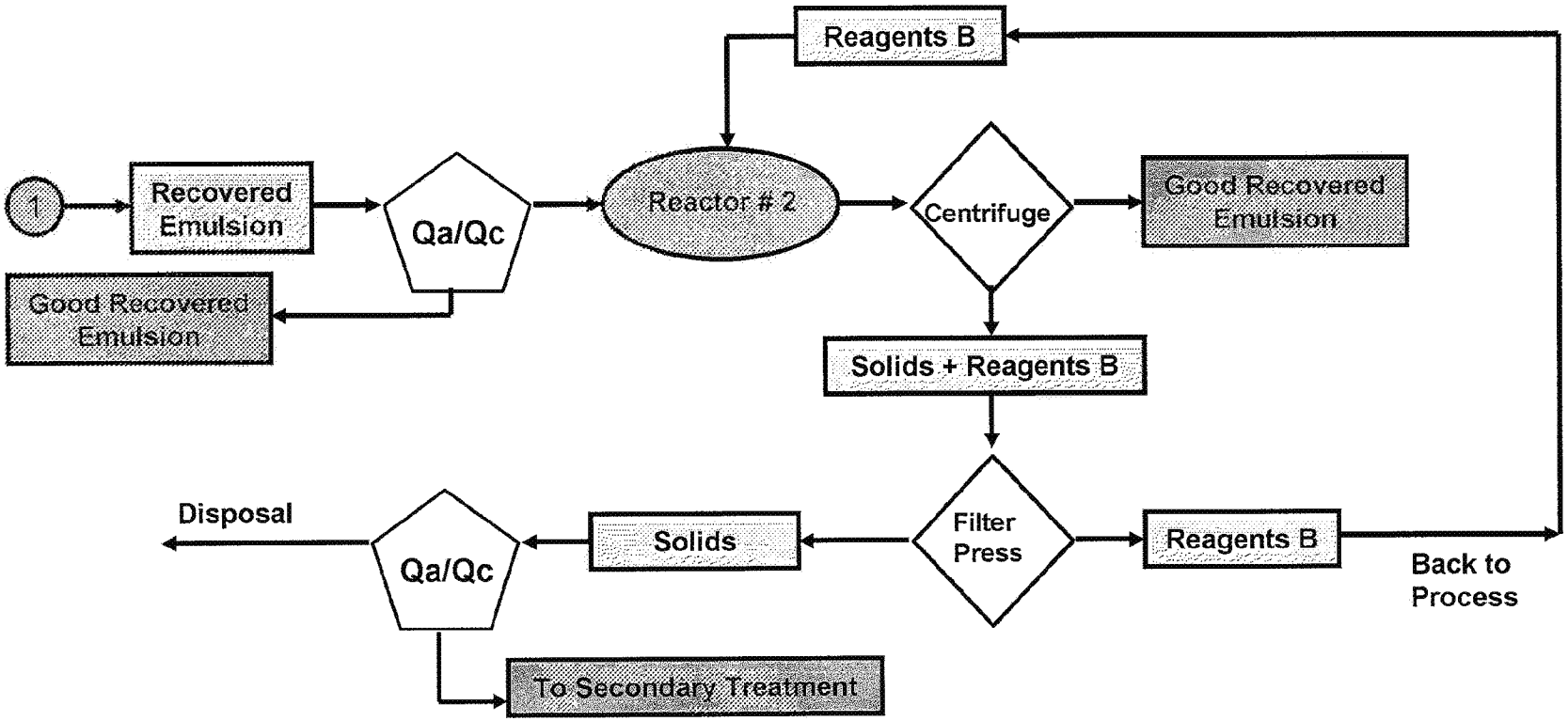
FIG. 2 illustrates part 2 of the emulsion recovery process of the present invention.

The reacted mix is now pumped into a centrifuge for the separation of the LGS from the emulsion. The speed of the centrifuge must be controlled for an accurate separation. The LGS wet with emulsion will be dropped out and the recovered emulsion will form the overflow of the centrifuge, if the electrolyte was used it will be separated into a third phase using a filter press or any other filtration mechanism and will be reused in another cycle as shown in FIG. 2. The recovered LGS from this process will be tested for hydrocarbon concentration; if this would exceed the maximum levels allowed for disposal then these are sent to the secondary treatment described in FIG. 3.

Figure 3:
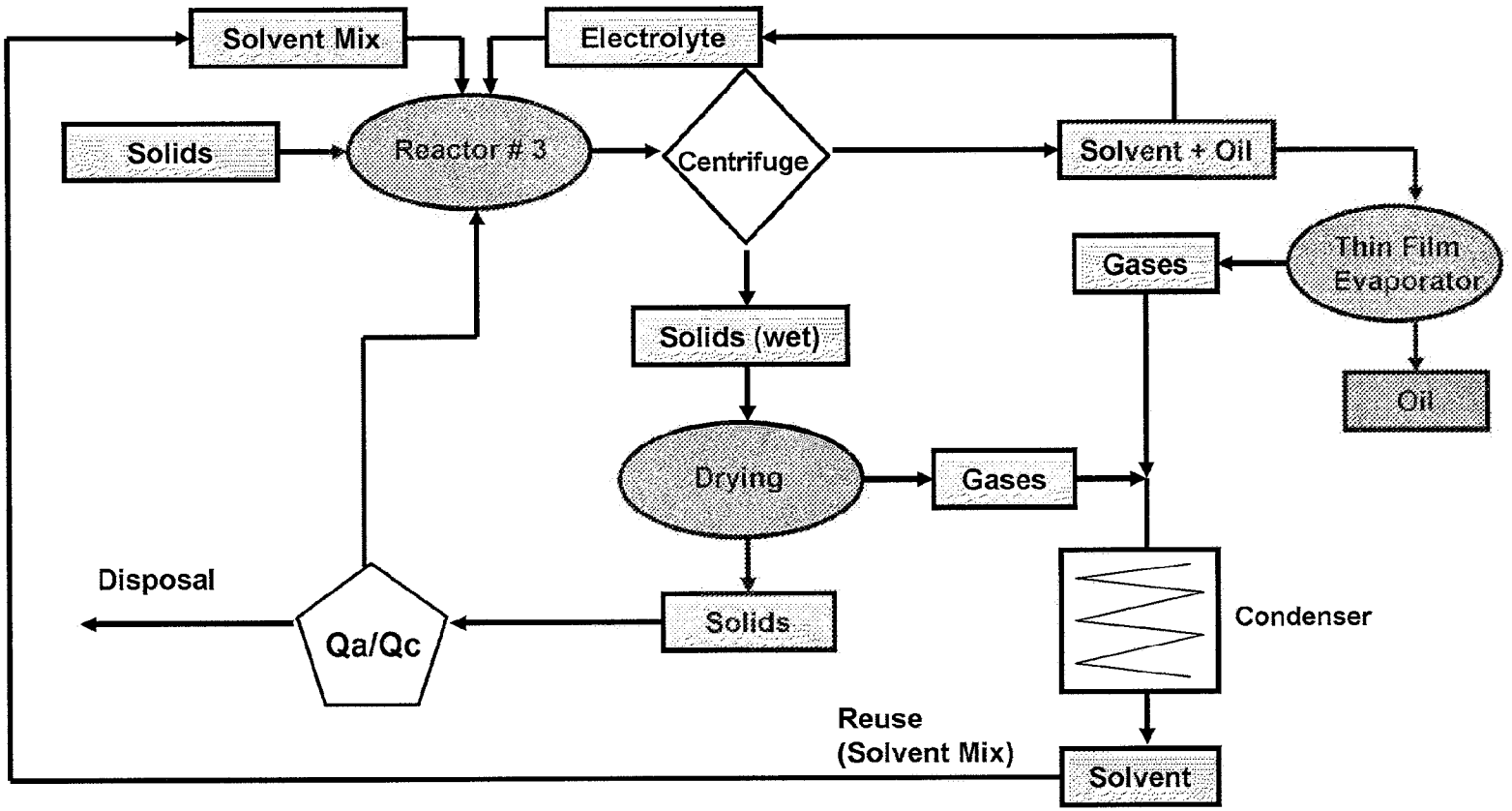
FIG. 3 illustrates a secondary treatment of the emulsion recovery process of the present invention.

The recovered emulsion should, at this time, pass quality assurance parameters and be ready for reuse. In case that the parameters are more stringent, the emulsion can be "washed" inside a second reactor fitted with an agitator and a chemical feeding system. The recovered emulsion is pumped into the second reactor and is agitated as illustrated in FIG. 2. A solution of the ethylene glycol group is added and agitated for at least 3 minutes. A second reagent from the group of the alcohols, like methanol, is now added to the mix while agitation continues for at least 1 minute. Finally, a light electrolyte like sodium hypochlorite is added to the mixture and is agitated for at least 1 minute according to Table 1. The mixture is now centrifuged to separate the clean emulsion. The underflow is filtered and the reagents are recovered for reuse. The LGS are tested for disposal quality, if failed, they are sent for further processing for Secondary Treatment as depicted in FIG. 3.

The Secondary treatment of the emulsion recovery process of present invention for solids consists in introducing such solids into a third reactor, which contains a bath of solvent and is fitted with an agitator that promotes the formation of slurry. The solvent is non-miscible in water and is made out of an azeotropic mixture of aliphatic or aromatic hydrocarbons, alcohols and ketones as tabulated in Table 1. This mixture is prescribed by approximating the Hansen solubility parameters of such mixture to the Hansen solubility parameters of the oil used in the preparation of the emulsion. This can be achieved by using a computer program for the optimization of the solvent components. An electrolyte can be added here to promote separation.

The slurry from this reactor is pumped through a centrifuge to separate the solids from the liquids. The underflow solids are now diverted into a drying process that consists in heated augers with a gas withdraw system to collect the vaporized solvent using a vacuum compressor that pumps it into a water cooled condenser for its recovery and reuse. The solids go through a quality assurance analysis, if they pass the required levels for hydrocarbon concentration they can be discarded or sold as cement additives. If the parameters are not met, the solids are sent back to the third reactor for another pass, to start the secondary treatment one more time.

The overflow from the centrifuge is sent to a gravity tank where the electrolyte is decanted and sent back for reuse. The mix oil or solvent is now sent to an evaporator where the solvent is evaporated from the oil. The oil is now recovered and can be used. The solvent vapors are withdrawn from the evaporator using a vacuum compressor that pumps it into a water-cooled condenser for its recovery and reuse. The temperature used for the recovery is above the solvent's boiling point and below the oil's boiling point.

The invention claimed is:

1. A process for recovering an oil-based drilling fluid from used oil-based drilling mud, the used oil-based drilling mud having drilling cuttings material and a fluid phase, the fluid phase having high gravity solid material and low gravity solid material, the process comprising:

separating the drilling cuttings material from the fluid phase of the used oil-based drilling mud, the step of separating the drilling cuttings material from the fluid phase of the used oil-based drilling mud further comprising screening the used oil-based drilling mud;

separating the high gravity solid material from the fluid phase of the used oil-based drilling mud the step of separating the high gravity solid material from the fluid phase of the used oil-based drilling mud at least one, further comprising centrifuging the used oil-based drilling mud, such centrifugation discharging a first overflow fraction and a first underflow fraction, the first overflow fraction comprising an emulsion and low gravity solid material and the first underflow fraction comprising high gravity solid material; and separating the low gravity solid material from the fluid phase of the used oil-based drilling mud, the step of separating the low gravity solid material from the fluid phase of the used oil-based drilling mud further comprising:

exothermically reacting the first overflow fraction such that the emulsion and at least some of the low gravity solid material is separated; and centrifuging the reacted first overflow fraction such that a second overflow fraction is discharged, the second overflow fraction substantially comprising the emulsion and a reduced amount of low gravity solid material, and further such that a second underflow fraction is discharged, the second underflow fraction comprising the separated low gravity solid material.

2. The process of claim 1, wherein the used oil-based mud fluid phase further comprises contaminants in addition to the low gravity solid material, and further wherein the exothermic reacting of the first overflow fraction separates at least some of the additional contaminants.

3. The process of claim 1, further comprising chemically washing the second overflow fraction, then centrifuging the washed second overflow fraction such that a third overflow fraction is discharged, the third overflow fraction substantially comprising the emulsion and a further reduced amount of low gravity solid material, and further such that a third underflow fraction is discharged, the third underflow fraction comprising at least some of the second overflow fraction separated low gravity solid material.

4. The process of claim 1, wherein exothermically reacting the first overflow fraction further comprises:

adding the first overflow fraction to an inorganic salt, the inorganic salt concentration being between 0.5 gr/lt of the first overflow fraction to 5.0 gr/lt of the first overflow fraction, for at least 2 minutes agitation time;

adding a carbon in the range of 0.5 gr/lt of the first overflow fraction to 3.5 gr/lt of the first overflow fraction and agitating for at least 1 minute, the carbon being selected from the group consisting of carbon powder and carbon black;

starting the exothermic reaction by adding a peroxide in the range of 15 ml/lt of the first overflow fraction to 35 ml/lt of the first overflow fraction, the concentration of the peroxide ranging from 35% to 50% prior to adding, the first overflow fraction with the added peroxide being continuously agitated, the agitation accelerating the exothermic reaction;

adding a catalyst in the range of 0.1 gr/lt of the first overflow fraction to 1.0 gr/lt of the first overflow fraction, the catalyst being selected from the group consisting of perchlorate salt, permanganate salt, and potassium permanganate; and adding an electrolyte, the electrolyte being selected from the group consisting of ammonia and sodium hypochlorite, the electrolyte concentration being in the range of 1.0% minimum v/v and 12% maximum v/v in an amount of 100 ml/lt of the first overflow fraction to 600 ml/lt of the first overflow fraction.

5. The process of claim 4, wherein the peroxide is selected from the group consisting of organic peroxides and metallic peroxides.

6. A process according to claim 4, wherein separating the low gravity solid material from the fluid phase of the used oil-based drilling mud, further comprises:

washing the second overflow fraction emulsion by reacting and agitating the second overflow fraction emulsion in a mixture, the mixture comprising at least one reagent compound of the form X—R—X, at least one reagent compound of the form R—X where R is an alkyl radical with 1 to 8 carbons, and X is a hydroxyl radical, and an electrolyte in an amount up to and including 300 ml/lt of emulsion; and centrifuging the washed second overflow fraction emulsion, the centrifugation separating the second overflow fraction emulsion into a third overflow fraction, comprising a second emulsion, and a third underflow fraction, comprising at least one of the reagents and low gravity solid material.

7. The process of claim 6, wherein the at least one reagent of the form X—R—X comprises ethylene glycol at 150-300 ml/l.

8. The process of claim 6, wherein the at least one reagent of the form R—X comprises methanol at 300 ml/l.

9. The process of claim 6, wherein up to and including 300 ml/lt of the electrolyte is added and the electrolyte is selected from the group consisting of ammonia and sodium hypochlorite up to and including 300 ml/l.

10. The process of claim 6, wherein the step of separating the low gravity solid material from the fluid phase of the used oil-based drilling mud, further comprises:

filtering, using a filter press, the third underflow portion such that the at least one reagent and the low gravity solid material are separated; and routing the separated at least one reagent for reuse.

11. The process of claim 10, further comprising, secondarily treating at least some of the low gravity solid material separated from the at least one reagent, the secondarily treated portion of the separated low gravity solid material being oil-wet, the secondary treatment comprising:

adding a compound organic solvent that is non-miscible in water to the separated low gravity solid material;

mixing thoroughly;

centrifuging the mixture thereby separating the low gravity solid material from the solvent and the oil;

disposing of such low gravity solid material; and retaining the mixture of separated oil and solvent.

12. The process of claim 11, wherein the secondary treatment is optional in accordance with the results of at least one test, the test being selected from the group consisting of a total petroleum hydrocarbons concentration (mg/kg) and a toxicity characteristics leaching procedure.

13. The process of claim 10 further comprising, secondarily treating at least some of the low gravity solid material separated from the at least one reagent, the secondarily treated portion of the separated low gravity solid material being oil-wet, the secondary treatment comprising:

combining the separated low gravity solid material with a non-water miscible mixture of organic solvents, the solvents comprising at least one ester, at least one alcohol, at least one acetate, and at least one ketone in a reactor to form a slurry, the slurry having a liquid phase and a solid phase;

adding a light electrolyte to the combination;

separating the slurry liquid phase from the solid phase, the liquid phase including the solvent and oil, the solid phase having low gravity solid material and residual solvent;

separating the low gravity solid material from the residual solvent by evaporation;

disposing of the low gravity solid material; and separating the oil from the solvent in the liquid phase by evaporation;

routing the separated oil for reuse; and condensing the evaporated solvent and routing the liquid solvent for reuse.

14. The process of claim 4, wherein the inorganic salt and carbon are present in amounts necessary to maintain an oil to water ratio in the range of 60/40 to 90/10.

15. The process of claim 4, wherein the second underflow fraction further comprises at least the electrolyte and low gravity solid material, and the step of separating low gravity solid material from the fluid phase of the used oil-based drilling mud, further comprises:

filtering, using a filter press, the second underflow portion such that the electrolyte and the low gravity solid material are separated; and routing the separated electrolyte for reuse.

16. The process of claim 15, further comprising, secondarily treating at least some of the low gravity solid material separated from the electrolyte, the secondarily treated portion of the separated low gravity solid material being oil-wet, the secondary treatment comprising:

adding a compound organic solvent that is non-miscible in water to the separated low gravity solid material;

mixing thoroughly;

centrifuging the mixture thereby separating the low gravity solid material from the solvent and the oil;

disposing of such low gravity solid material; and retaining the separated oil and solvent.

17. The process of claim 16, wherein the secondary treatment is optional in accordance with the results of at least one test, the test being selected from the group consisting of a total petroleum hydrocarbons concentration (mg/kg) and a toxicity characteristics leaching procedure.

18. The process of claim 15 further comprising, secondarily treating at least some of the low gravity solid material separated from the electrolyte, the secondarily treated portion of the separated low gravity solid material being oil-wet, the secondary treatment comprising:

combining the separated low gravity solid material with a non-water miscible mixture of solvents, the solvents comprising an azeotropic mixture of at least one alcohol, at least one ketone, and at least one hydrocarbon, the hydrocarbon being selected from the group consisting of aliphatic hydrocarbons and aromatic hydrocarbons, in a reactor to form a slurry, the slurry having a liquid phase and a solid phase;

adding a light electrolyte to the combination;

separating the slurry liquid phase from the solid phase, the liquid phase including the solvent and oil, the solid phase having low gravity solid material and residual solvent;

separating the low gravity solid material from the residual solvent by evaporation;

disposing of the low gravity solid material; and separating the oil from the solvent in the liquid phase by evaporation;

routing the separated oil for reuse; and condensing the evaporated solvent and routing the liquid solvent for reuse.

19. The process of claim 18, wherein the electrolyte is added at a concentration of up to and including 2.0% v/v In an amount of 400 ml/lt to 750 ml/lt of the slurry volume.

20. The process of claim 18, wherein separating the liquid phase from the solid phase comprises centrifugation.

21. The process of claim 18, wherein the solvent is volatized and vacuumed through a condenser.

22. The process of claim 18, wherein the disposed low gravity solid material contains up to 3% oil by weight after solvent evaporation.

23. The process of claim 18, wherein the solvent further comprises at least one acetate.

24. The process of claim 18, wherein the solvent further comprises at least one ester.

25. The process of claim 4, wherein the inorganic salt is selected from the group consisting of sodium phosphates, potassium phosphates, and chlorides.

26. The process of claim 4, wherein the peroxide is selected from the group consisting of hydrogen peroxide, sodium peroxide, and zinc peroxide.

27. The process of claim 4, wherein at least some of the peroxide is added before the catalyst is added, and at least some of the peroxide is added after the catalyst is added.

28. The process of claim 1, wherein exothermically reacting the first overflow fraction further comprises:

adding the first overflow fraction to an inorganic salt in the range 0.5 gr/lt of fluid to 5.0 gr/lt of the first overflow fraction for at least 2 minutes agitation time;

adding a carbon in the range of 0.5 gr/lt to 3.5 gr/lt and agitating for at least 1 minute, the carbon being selected from the group consisting of carbon powder and carbon black;

adding a peroxide in the range of 15 ml/lt to 35 ml/lt, on a 35% to 50% concentration basis, the peroxide being selected from the group consisting of organic peroxide, metallic peroxide, hydrogen peroxide, sodium peroxide and zinc peroxide;

adding a catalyst in the range of 0.1 gr/lt to 1.0 gr/lt, the catalyst being selected from the group consisting of perchlorate salt, permanganate salt and potassium permanganate;

adding a peroxide in the range of 15 ml/lt to 35 ml/lt, on a 35% to 50% concentration basis, the peroxide being selected from the group consisting of organic peroxide, metallic peroxide, hydrogen peroxide, sodium peroxide and zinc peroxide, with agitation such that the exothermic reaction continues to evolve; and adding an electrolyte, the electrolyte being selected from the group consisting of ammonia and sodium hypochlorite, the electrolyte concentration being in the range of 1.0% minimum v/v and 12% maximum v/v, in an amount of 100 ml/lt to 600 ml/lt.

29. The process of claim 1, wherein the second overflow fraction emulsion is from a supernatant obtained during the centrifugation of the exothermically reacted first overflow fraction.

30. The process of claim 1, wherein the centrifugation of the used oil-based drilling mud is continuous until high gravity solid material above 10 microns is separated from the fluid phase.

31. The process of claim 1, wherein the high gravity solid material comprises at least a weighing material.

32. The process of claim 31, wherein the weighing material is barite.

33. The process of claim 1, wherein high gravity solid material above 10 microns is separated from the fluid phase.

34. The process of claim 1, wherein the centrifugation of the used oil-based drilling mud is continuous until barite above 5-7 microns is separated from the fluid phase.

35. A process for recovering an oil-based drilling fluid from used oil-based drilling mud, the used oil-based drilling mud having drilling cuttings material and a fluid phase, the fluid phase having high gravity solid material and low gravity solid material, the process comprising:

separating the drilling cuttings material from the fluid phase, leaving a first modified fluid phase;

separating at least some of the high gravity solid material from the first modified fluid phase, leaving a second modified fluid phase;

separating at least some of the low gravity solid material from the second modified fluid phase to form a third modified fluid phase by:

exothermically reacting the second modified fluid phase in a reactor using a plurality of reagents and agitation; and centrifuging the reacted second modified fluid phase, such that low gravity solid material is removed from the second modified fluid phase leaving the third modified fluid phase.

36. The process of claim 35, further comprising:

separating additional low gravity solid material from the third modified fluid phase to form a fourth modified fluid phase by:

reacting the third modified fluid phase in a second reactor using water, a plurality of reagents and agitation; and centrifuging the reacted third modified fluid phase, such that the low gravity solid material is removed from the third modified fluid phase leaving the fourth modified fluid phase.

37. The process of claim 36, wherein the plurality of reagents comprises a glycol, an alcohol, and an electrolyte.

38. The process of claim 37, wherein the glycol is selected from the group consisting of ethylene glycol, and propylene glycol.

39. The process of claim 37, wherein the alcohol is methanol.

40. The process of claim 37, wherein the electrolyte is selected from the group consisting of ammonia and sodium hypochlorite.

41. The process of claim 36, further comprising:

bathing and agitating the removed low gravity solid material in a solvent in a third reactor, the bathing and agitating forming a slurry;

centrifuging the slurry such that the bathed low gravity solid material and at least some of the solvent are separated; and drying the bathed low gravity solid material for additional separation of the low gravity solid material from the solvent.

42. The process of claim 41, wherein the solvent comprises at least one alcohol, at least one ketone, and an azeotropic mixture having a hydrocarbon, wherein the hydrocarbon is selected from group consisting of an aliphatic hydrocarbon, and an aromatic hydrocarbon.

43. The process of claim 42, wherein an electrolyte is added to the third reactor during the bathing and agitating.

44. A system for recovering an oil-based drilling fluid from used oil-based drilling mud, the used oil-based drilling mud having drilling cuttings material and a fluid phase, the fluid phase having high gravity solid material and low gravity solid material, the process comprising:

means for separating the drilling cuttings material from the fluid phase, leaving a first modified fluid phase;

means for separating at least some of the high gravity solid material from the first modified fluid phase, leaving a second modified fluid phase;

means for separating at least some of the low gravity solid material from the second modified fluid phase to form a third modified fluid phase, such means further comprising:

means for exothermically reacting the second modified fluid phase in a reactor using a plurality of reagents and agitation; and means for centrifuging the reacted second modified fluid phase, such that low gravity solid material is removed from the second modified fluid phase leaving the third modified fluid phase.

* * * * *